United States Patent [19]

McInnes

[11] 4,390,399

[45] Jun. 28, 1983

[54] METHOD AND APPARATUS FOR PLATING ARTICLES

[76] Inventor: Robert McInnes, 1108 Fairway Dr., Linden, Mich. 48451

[21] Appl. No.: 209,867

[22] Filed: Nov. 24, 1980

[51] Int. Cl.[3] ..... C25D 17/20

[52] U.S. Cl. ..... 204/32 R; 204/201; 204/213

[58] Field of Search ..... 204/32 R, 213, 214, 204/199, 200, 201

[56] References Cited

U.S. PATENT DOCUMENTS

| | | | |
|---|---|---|---|
| 2,830,946 | 4/1958 | Pleadwell | 204/222 |
| 3,850,737 | 11/1974 | Lui | 204/213 |
| 3,855,107 | 12/1974 | McInnes | 204/201 |

*Primary Examiner*—Winston A. Douglas
*Assistant Examiner*—William Leader
*Attorney, Agent, or Firm*—Barnes, Kisselle, Raisch, Choate, Whittemore & Hulbert

[57] ABSTRACT

A cleaning and plating method and apparatus comprising a plurality of tank assemblies arranged in series through which a batch of articles to be cleaned and plated is moved successively. Each tank assembly comprises a tank containing liquid treating or plating material. A barrel is at least partly submerged in each tank and is rotated about its longitudinal axis. The ends of the barrel are open and the barrel is formed with baffles on the interior thereof. When the barrel is rotated in one direction, the articles are agitated through the liquid and when the barrel is rotated in the other direction, the articles are elevated and deposited on a chute for transfer to the next succeeding tank assembly. Anodes and cathodes are positioned within at least some of the barrels and provision is made for elevating the anodes and cathodes out of contact with the parts or liquid in the tank assemblies when the barrels are rotated in the other direction to transfer the articles and thereafter returning them into control with the liquid.

13 Claims, 5 Drawing Figures

METHOD AND APPARATUS FOR PLATING ARTICLES

This invention relates to cleaning and plating and particularly to a method and apparatus for plating.

BACKGROUND AND SUMMARY OF THE INVENTION

In U.S. Pat. No. 3,855,107, there is disclosed a cleaning and plating method and apparatus comprising a plurality of tank assemblies arranged in series through which a batch of articles to be cleaned and plated is moved successively. Each tank assembly comprises a tank containing liquid treating or plating material. A barrel is at least partly submerged in each tank and is rotated about its longitudinal axis. The ends of the barrel are open and the barrel is formed with baffles on the interior thereof. When the barrel is rotated in one direction, the articles are agitated through the liquid and when the barrel is rotated in the other direction, the articles are elevated and deposited on a chute for transfer to the next succeeding tank assembly. Provision is made for supplying electrical power to some of the assemblies in order to plate the article.

Specifically, anodes are suspended in the tank externally of the barrel and cathodes are made a part of the barrel.

Such an arrangement of electrodes necessitates a complex and expensive arrangement of connections to the cathode utilizing a ring type bus bar, brushes to the bar and construction of the barrel to provide a circuit to the interior of the barrel. In addition, such an arrangement requires substantial use of current because of the external and internal placement of the electrodes resulting in greater cost and requiring more time for the plating.

Accordingly, the present invention is directed to an improved method and apparatus that obviates the aforementioned objections, which functions to plate more quickly and economically and which utilized an apparatus that is more simple and less expensive.

In accordance with the invention cathodes and anodes are mounted within the barrel and provision is made for elevating them within the barrel out of contact with the parts or liquid in the tank assemblies when the barrel is rotated in the other direction to transfer the articles and thereafter returning them into contact with the liquid.

DESCRIPTION

Figure 1:
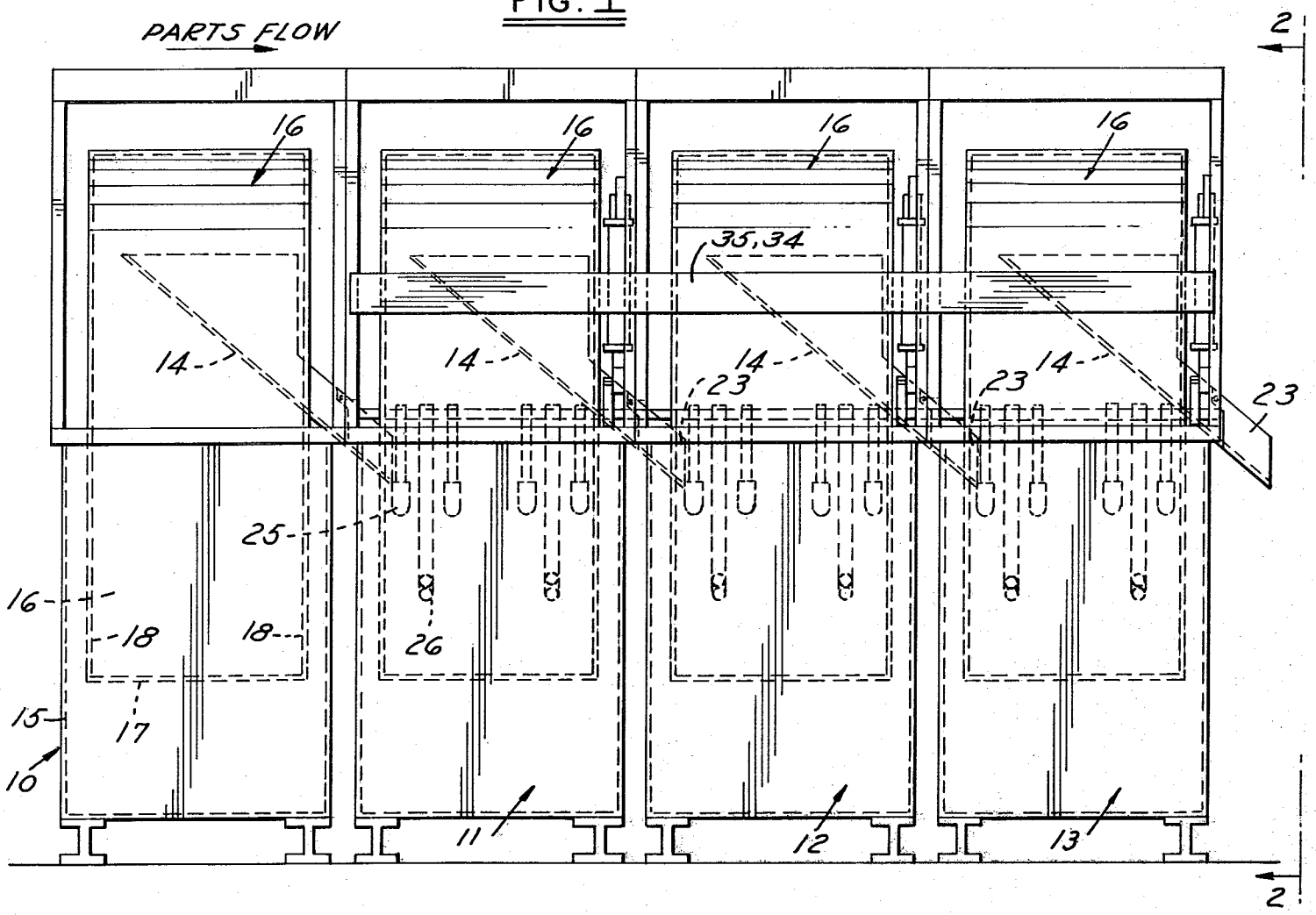
FIG. 1 is a side elevational view of a system embodying the invention.

Referring to FIG. 1, the cleaning and plating system embodying the invention is shown in connection with a particular plating but, as will be apparent, it can be adapted to other types of plating. The articles to be plated are fed from a metering hopper (not shown) periodically in a batch to a first tank assembly 10. The articles are treated in the tank assembly 10 and then are delivered, as presently described, to a successive tank assemblies 11, 12, 13.

The tank assemblies 10, 11 as well as the other tank assemblies 12 in the system are of substantially identical construction, as will be hereinafter described, except that where electrical power is required for plating, additional provision is made for the application of such electrical power.

After treatment in tank assembly 10, the articles are then fed to another tank assembly 11 and so on to successive assemblies 12, 13 in order. By the arrangement shown, each tank assembly is working or performing a function on a batch of the articles while the other tank assemblies are providing their functions on other batches of the articles.

In the plating system, the successive tank assembly 10 perform the functions of cleaning while tank assemblies 11, 12, 13 perform the functions of plating.

In the transfer of articles between successive assemblies, chutes 14 are provided as presently indicated.

As discussed above, each tank assembly 10–13, as well as additional tank assemblies in the system, which are not shown, is substantially identical in construction except for the inclusion or omission of the electrical components for applying power.

Referring to FIG. 1, each tank assembly 10–13 includes a container or tank 15 which is adapted to hold the treating or plating liquid, as the case may be. Each tank assembly further includes a barrel 16 that is generally cylindrical and includes an outer cylindrical wall 17 and annular flat radial end walls 18. The barrel 16 is made of plastic material such as polypropylene and the walls 17, 18 are formed with holes 19*a* (FIG. 2) to permit the ready passage of liquid and current therethrough.

Figure 2:
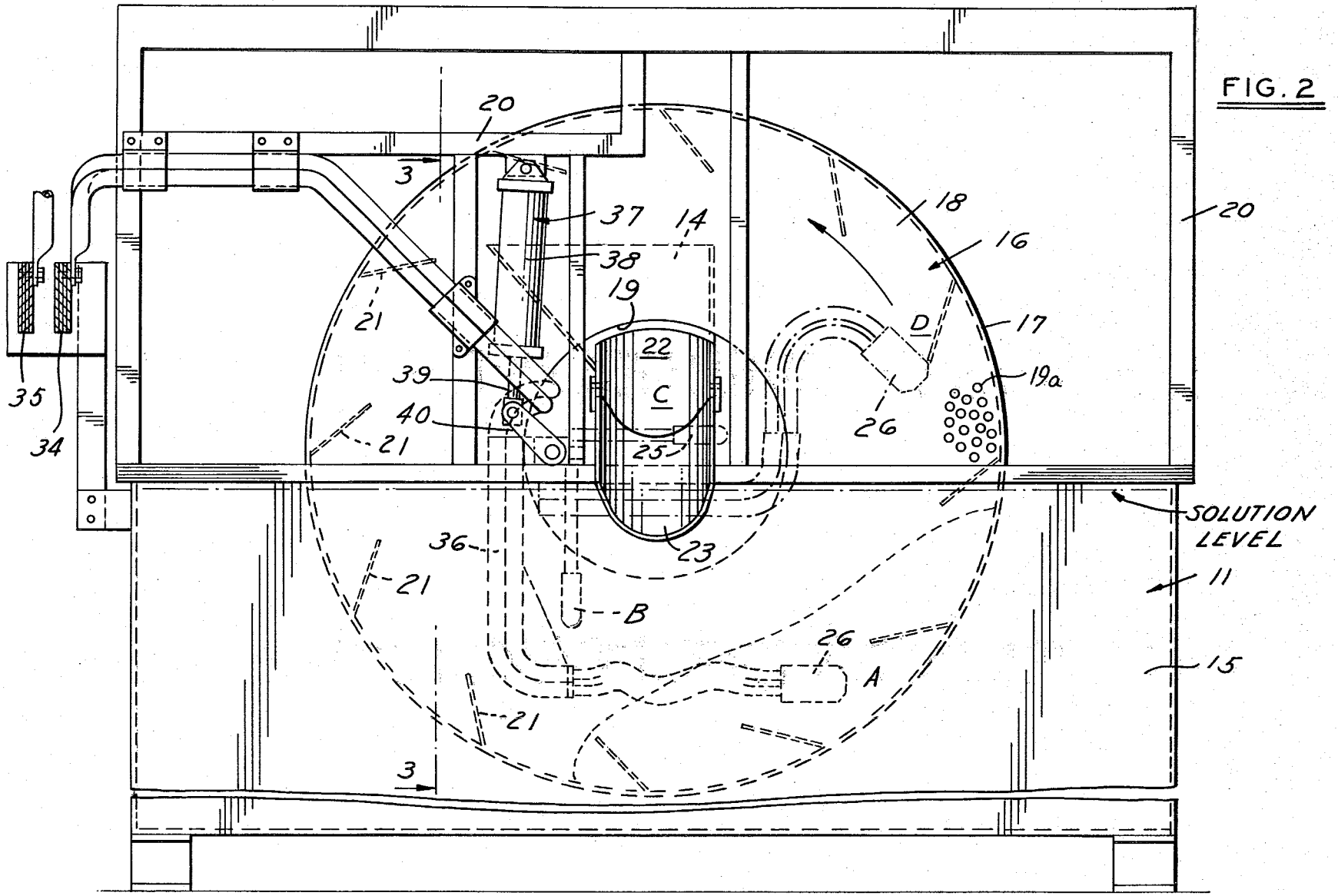
FIG. 2 is a fragmentary view taken along the line 2—2 in FIG. 1.
Figure 4:
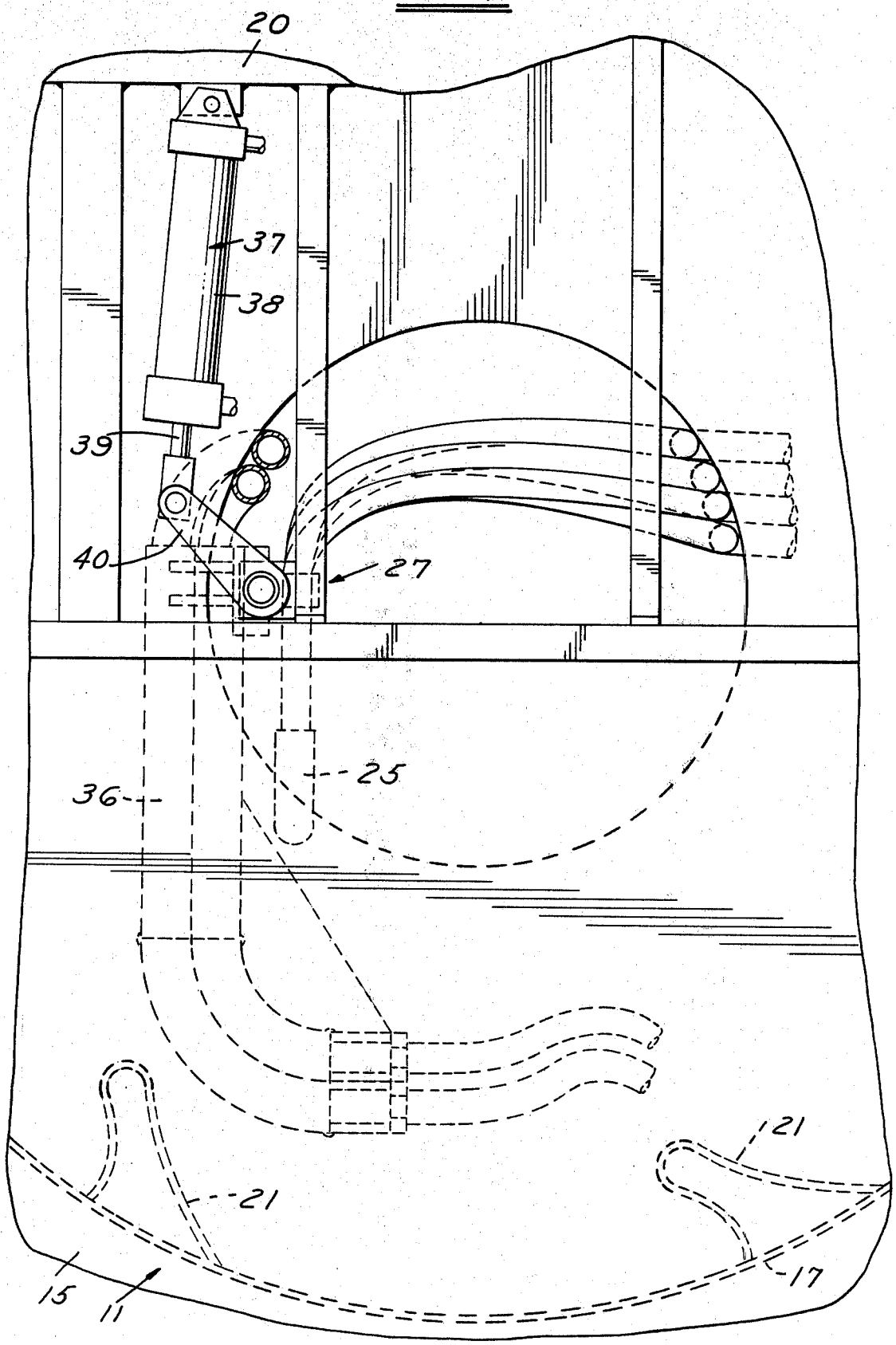
FIG. 4 is a fragmentary sectional view taken along the line 4—4 in FIG. 3.

Each barrel is rotatably supported in its respective tank by endless chains trained so around the barrels and driven by a motor on the frame 20 above each tank. Baffles 21 also made of plastic material extend transversely between the spaced radial walls of each barrel (FIGS. 2, 4).

Each barrel includes a plurality of baffles 21 that extend at an acute angle.

Each chute 14 comprises sections or portions 22, 23 pivoted to one another. The chute 14 further flares from a wide transverse section adjacent the upper end within the tank to a narrow section at the adjacent tank to which the parts are fed. In addition, the chute includes flared portions at its upper end within the tank which extend upwardly and forwardly to assist in collecting the parts and directing them downwardly during the transfer when the barrel rotation is reversed.

Pivoted chute portion 23 is normally positioned so that parts will be returned to the barrel and be prevented from accidently passing to the adjacent barrel when the barrel is rotated in the normal running direction.

In operation, a metering hopper (not shown) in turn periodically feeds a batch of articles to the first tank 10. The tank assembly is then rotated for a predetermined period of time in one direction to treat the articles and then the rotation is reversed to elevate and feed the articles to the next successive tank assembly. The barrel of the next tank assembly then rotates to treat the articles. After first tank assembly 10 delivers the articles to next tank assembly, a new batch of articles is delivered to the first tank assembly. In this fashion after a predetermined interval of time corresponding to the number of tank assemblies, each tank assembly is either treating articles or delivering articles to the next successive tank assembly.

The number of tank assemblies for any particular operation, that is any particular treatment, depends upon the amount of time required for that treatment. Thus, an assembly is provided for the shortest needed treatment. Then if there is another treatment that requires a greater length of time, that particular treatment utilizes two or more tank assemblies so that a portion of the treatment occurs during one cycle of the tank and another portion of the treatment occurs in the other tanks.

The cycle times are so adjusted that the reverse cycle of all is sufficiently long to discharge the batch of articles therefrom. With this background the detailed operation of the control circuitry is now described.

During normal cleaning or plating, the barrel of each drum rotates in a counterclockwise direction as viewed in FIG. 2 to cause a tumbling and agitation of the parts. During this operation, the pivoted portion 23 is in the up position. Any parts or liquid that may inadvertently be delivered to the chute 14 are returned back through an opening in the chute to the tank by the pivoted portion 23.

The above described construction is shown and described in the aforementioned U.S. Pat. No. 3,855,107 which is incorporated herein by reference.

In accordance with the invention anodes 25 and cathodes 26 are suspended in each plating tank assembly 11, 12, 13 and are mounted so that they normally extend into the plating solution or liquid as shown in positions A and B (FIG. 2). However, the anodes 25 and electrodes 26 are mounted, as presently described so that they can be elevated within the barrel out of contact with the liquid when the rotation of the barrel is reversed to transfer the articles.

Figure 5:
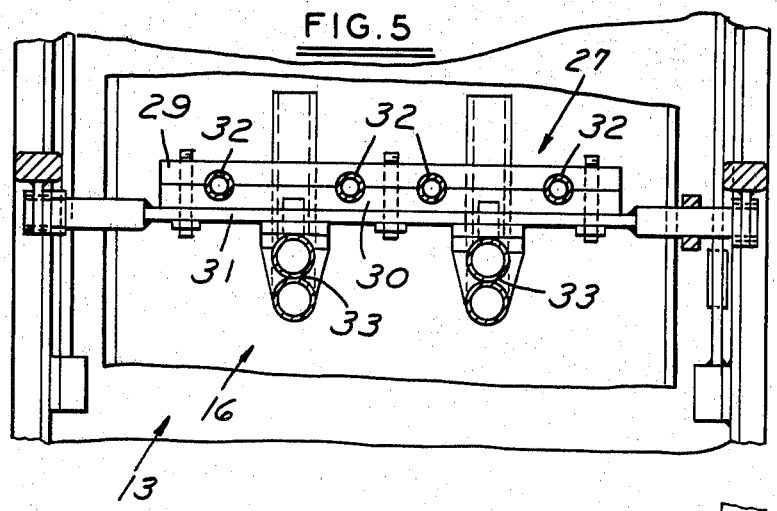
FIG. 5 is a fragmentary sectional view taken along the line 5—5 in FIG. 3.
Figure 3:
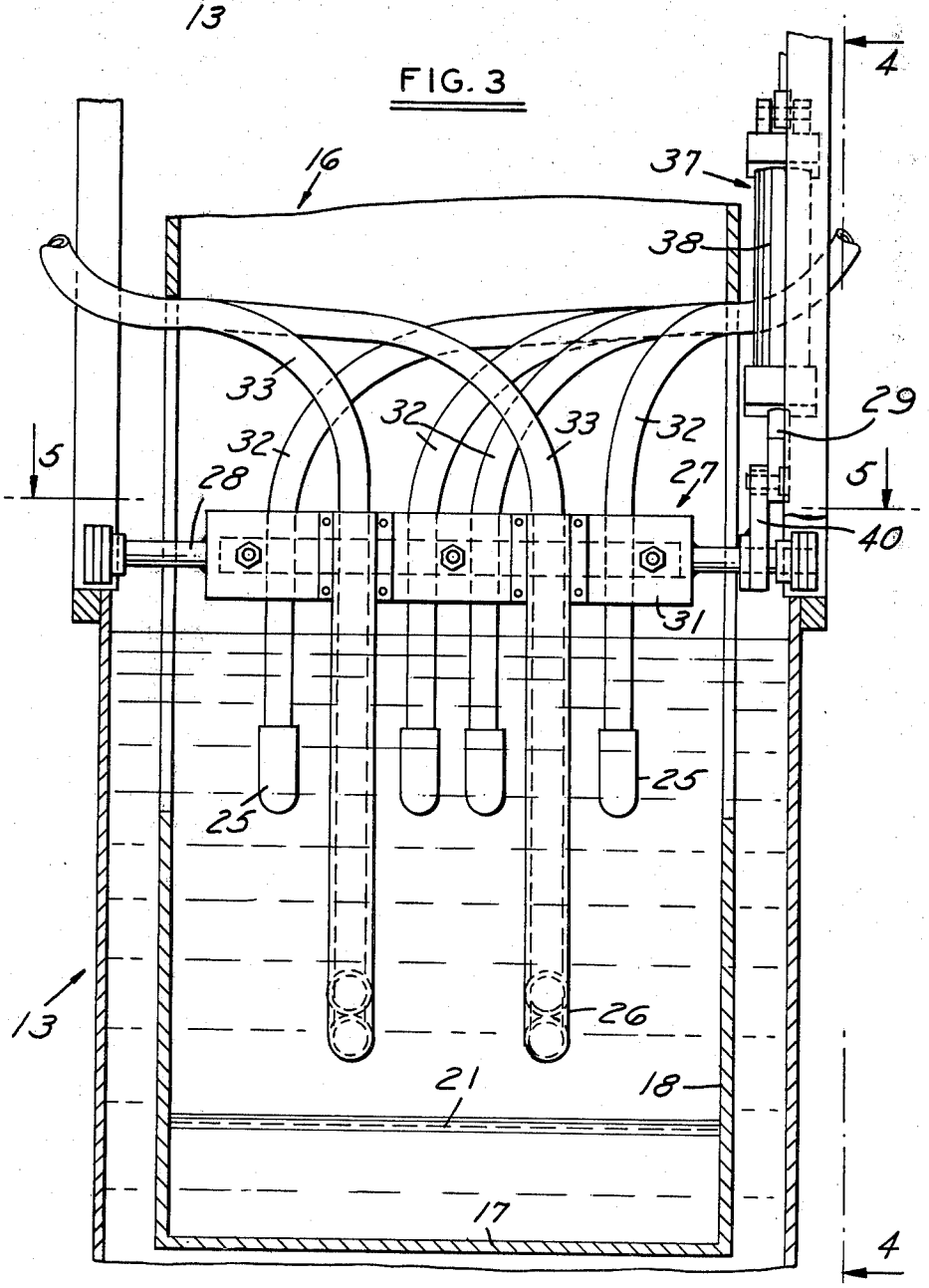
FIG. 3 is a fragmentary sectional view taken along the line 3—3 in FIG. 2.

As shown in FIGS. 3–5, the anodes 25 and electrodes 26 are mounted on a bracket assembly 27 which has a shaft 28 the ends of which are pivoted on bearings on the frame 20. The bracket assembly 27 comprises bars 29, 30 mounted on an intermediate flatened portion 31 of shaft 28 between which intermediate portions of the cables 32, 33 which extend to the anodes 25 and cathodes 26 are clamped. The cables 32, 33 extend through the openings 19 in the barrel 16 to bus bars 34, 35 that are mounted on but electrically insulated from the frames 20 and extend alongside tank assemblies 11, 12, 13 (FIGS. 1, 2). Cables 33 which extend to the cathodes are encased in a relatively rigid casing 36 that is L-shaped so that when the casing 36 is in the vertical position A as shown in FIG. 2, the flexible ends of the cables extend generally horizontally to the exposed cathodes 26 which engage the articles in the barrel 16. The portions of the cables to the anodes 25 are also flexible.

As shown in FIGS. 2 and 3, a linear motor 37 has its housing 38 outside the barrel pivoted at the frame 20 and its piston rod 39 pivoted to a crank arm 40 fixed to the shaft 28 of bracket assembly 27. When the rotation of the barrel 16 is reversed to transfer articles, the motor 37 is actuated to move the anodes 25 and cathodes 26 to the positions C and D (FIG. 2) out of contact with the parts or plating solution or liquid.

Thus, the apparatus provides a simple low cost construction which permits better plating in a shorter time.

I claim:

1. In an apparatus for cleaning and plating articles, the combination comprising a plurality of tank assemblies comprising a plurality of containers adapted to contain liquid treating material, a barrel adapted to be at least partially submerged in liquid in each said container, each said barrel having a longitudinal axis, means for supporting each said barrel rotatably about a fixed generally horizontal axis so that a portion of the barrel is submerged in liquid in said container when liquid is in the container, each said barrel having end walls, each end wall having an opening therethrough along the longitudinal axis of the barrel, each said barrel having a plurality of circumferentially spaced baffles on the inner periphery thereof extending axially between the end walls, said baffles extending generally radially inwardly and forming an acute angle with the inner periphery of the barrel and spaced from said openings such that when the barrel is rotated in one direction, said baffles agitate the articles, and when said barrel is rotated in the opposite direction, said baffles elevate the articles and the cause them to drop, and chute means extending at an angle from the interior of one said barrel adjacent one end wall through the other end wall to the interior of the succeeding barrel such as to guide articles dropped by the baffles by gravity to the succeeding barrel, the improvement comprising at least one anode, at least one cathode, means for mounting said anodes and cathodes within a barrel for movement between a first position where said anodes and cathodes are in the liquid when the barrel is rotated in one direction to agitate and plate the articles and a second position when said anodes and cathodes are out of contact with the parts and liquid when the barrel is rotated to transfer the articles, and means for moving said anodes and cathodes between said first and second positions.

2. The apparatus set forth in claim 1 wherein said cathodes extend in the direction of rotation of the barrel and in contact with the articles in the barrel when said cathodes are within the liquid.

3. The apparatus set forth in either of claims 1 and 2 wherein bus bars extend along successive tank assemblies and means providing electrical connections between said anodes and cathodes and said bus bars.

4. The apparatus set forth in either of claims 1 and 2 wherein said means for mounting said anodes and cathodes includes bracket assembly on which said anodes and cathodes are mounted, said bracket assembly being pivotally mounted on said tank assembly, and means for pivoting said shaft to move said anodes and cathodes.

5. The apparatus set forth in claim 4 wherein said last mentioned means comprises a motor within the barrel.

6. The apparatus set forth in claim 5 wherein said motor comprises a linear motor.

7. In an apparatus for cleaning and plating articles, the combination comprising a container adapted to contain liquid treatment material, a barrel adapted to be partially submerged in liquid in said container, said barrel having a longitudinal axis, means for supporting said barrel rotatably about a fixed generally horizontal axis so that a portion of the barrel is submerged in liquid in said container when liquid is in the container, said barrel having end walls, each said end wall having an opening therethrough extending along the longitudinal axis of said barrel, said barrel having a plurality of circumferentially spaced baffles on the inner periphery thereof extending axially between said end walls of the barrels, said baffles extending generally radially inwardly and forming an acute angle with the inner periphery of the barrel such that when the barrel is rotated in one direction, said baffles agitate the articles, and when said barrel is rotated in the opposite direction, said baffles elevate the articles and then cause them to drop, and chute means extending from the interior of said barrel adjacent one end wall through the other end wall to the interior of a succeeding barrel such as to guide the articles dropped by the baffles by gravity to a succeeding barrel, the improvement comprising at least one anode, at least one cathode, means for mounting said anodes and cathodes within said barrel for movement between a first position where said anodes and cathodes are in the liquid when the barrel is rotated in one direction to agitate and plate the articles and a second position where said anodes and cathodes are out of contact with the liquid when the barrel is rotated to transfer the articles, and means for moving said anodes and cathodes between said first and second positions.

8. The apparatus set forth in claim 7 wherein said cathodes extend in the direction of rotation of the barrel and in contact with the articles in the barrel when said cathodes are within the liquid.

9. The apparatus set forth in either of claims 7 and 8 wherein bus bars extend along successive tank assemblies and means providing electrical connections between said anodes and cathodes and said bus bars.

10. The apparatus set forth in either of claims 7 and 8 wherein said means for mounting said anodes and cathodes includes bracket assembly on which said anodes and cathodes are mounted, said bracket assembly being pivotally mounted on said tank assembly, and means for pivoting said shaft to move said anodes and cathodes.

11. The apparatus set forth in claim 10 wherein said last mentioned means comprises a motor within the barrel.

12. The apparatus set forth in claim 11 wherein said motor comprises a linear motor.

13. In the method of cleaning and plating articles which comprises providing a plurality of separate substantially identical containers adapted to contain liquid treating material, providing a barrel in partially submerged relation to the liquid in each container, supporting each said barrel rotatably about a fixed generally horizontal axis so that a portion of the barrel is submerged in the liquid in its respective container, each said barrel having end walls, each said wall having an opening therethrough extending along the longitudinal axis of said barrel, said barrel having a plurality of circumferentially spaced baffles on the inner periphery thereof extending axially between said end walls, rotating each barrel for a predetermined interval of time individual to said barrel in one direction such that the baffles agitate the articles, thereafter rotating each said barrel in the opposite direction to cause said baffles to elevate the articles and permit them to fall solely by gravity freely downwardly, and providing a guide path from the interior of one said barrel to the interior of a successive barrel for receiving the articles falling by gravity and thereby guiding the articles as they move solely by gravity during the rotation of said barrel in said opposite direction into the succeeding barrel, the improvement comprising providing at least one anode and at least one cathode within at least one barrel, moving said anodes and said cathodes into contact with the liquid when the barrel is rotated in one direction to agitate and plate articles, moving said anodes and cathodes out of said liquid when the barrel is rotated to transfer articles while maintaining said anodes and cathodes within said barrel.

* * * * *